US008708446B2

(12) United States Patent
Kondo et al.

(10) Patent No.: US 8,708,446 B2
(45) Date of Patent: Apr. 29, 2014

(54) PRINTING DEVICE AND PRINTING METHOD

(75) Inventors: Takamitsu Kondo, Nagano (JP); Toru Takahashi, Nagano (JP); Hiroshi Wada, Nagano (JP); Toshio Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 13/406,003

(22) Filed: Feb. 27, 2012

(65) Prior Publication Data

US 2012/0223995 A1 Sep. 6, 2012

(30) Foreign Application Priority Data

Mar. 4, 2011 (JP) ..... 2011-047981

(51) Int. Cl.
*B41J 29/38* (2006.01)
*B41J 2/01* (2006.01)

(52) U.S. Cl.
USPC ..... 347/16; 347/9; 347/101; 347/102

(58) Field of Classification Search
USPC ..... 347/14, 16, 6, 9, 101–102
See application file for complete search history.

(56) References Cited

U.S. PATENT DOCUMENTS

2007/0165054 A1* 7/2007 Shimoji ..... 347/14
2011/0074857 A1* 3/2011 Mitsuzawa ..... 347/16

FOREIGN PATENT DOCUMENTS

JP 2005-199563 A 7/2005
JP 2006-088529 A 4/2006

* cited by examiner

*Primary Examiner* — Jason Uhlenhake
(74) *Attorney, Agent, or Firm* — Global IP Counselors, LLP

(57) ABSTRACT

To make it possible to easily provide printed matter with varying degrees of gloss, a printing device includes a head for ejecting a photo-curing ink to a medium, a photo-irradiation device for radiating light to the photo-curing ink ejected on the medium and curing the photo-curing ink, and a controller for causing an ejection and curing operation to be performed for ejecting the photo-curing ink and subsequently radiating the light to cure the photo-curing ink, the controller being configured so that when an image having a first degree of gloss is formed, the image is formed by a first number of ejection and curing operations, and when an image having a second degree of gloss lower than the first degree of gloss is formed, the image is formed by a second number of ejection and curing operations greater than the first number.

6 Claims, 10 Drawing Sheets

PRINTING DEVICE AND PRINTING METHOD

CROSS-REFERENCE TO RELATED APPLICATIONS

This application claims priority to Japanese Patent Application No. 2011-047981 filed on Mar. 4, 2011. The entire disclosures of Japanese Patent Application No. 2011-047981 is hereby incorporated herein by reference.

BACKGROUND

1. Technical Field

The present invention relates to a printing device and printing method.

2. Background Technology

Printing devices using ultraviolet-curing ink (referred to hereinafter as "UV ink") have been developed that cure the ink by emitting ultraviolet rays. Printing devices have also been developed which provide glossy printed matter by applying a coating of a transparent ink in printing using UV ink. Patent Citation 1 describes an image recording system for providing matte printed matter and glossy printed matter by using two types of transparent ink.

Japanese Patent Application Publication No. 2006-88529 (Patent Citation 1) is an example of the related art.

SUMMARY

Problems to Be Solved by the Invention

In the process described in Patent Citation 1, a glossy transparent ink for printing a glossy printed matter and a matte transparent ink for printing a matte printed matter must be loaded into the printer. Preparing two types of ink in this manner reduces the cost performance of the printing device. There is therefore a need to more easily provide printed matter with varying degrees of gloss.

The invention was developed in view of the foregoing, and an advantage of the invention is to make it possible to easily provide printed matter with varying degrees of gloss.

Means Used to Solve the Above-Mentioned Problems

The primary invention for achieving the abovementioned advantages is a printing device including:

a head for ejecting a photo-curing ink to a medium;

a photo-irradiation device for radiating light to the photo-curing ink ejected on the medium and curing the photo-curing ink; and a controller for causing an ejection and curing operation to be performed for ejecting the photo-curing ink and subsequently radiating the light to cure the photo-curing ink, the controller being configured so that when an image having a first degree of gloss is formed, the image is formed by a first number of ejection and curing operations, and when an image having a second degree of gloss lower than the first degree of gloss is formed, the image is formed by a second number of ejection and curing operations greater than the first number.

Other features of the invention will become apparent from the description of the present specification and accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
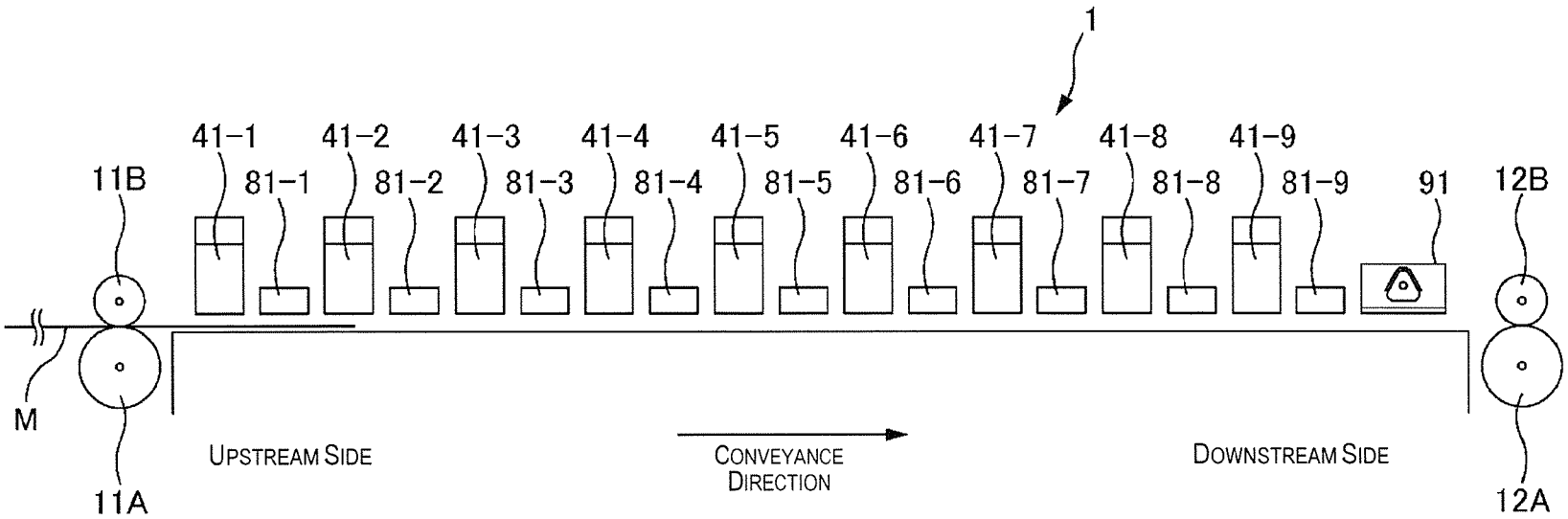
FIG. 1 is a rough side view showing the printer 1 according to a first embodiment.

At least the aspect described below will become apparent from the description of the present specification and accompanying drawings. Specifically, an aspect of the invention resides in a printing device including:

a head for ejecting a photo-curing ink to a medium;

a photo-irradiation device for radiating light to the photo-curing ink ejected on the medium and curing the photo-curing ink; and a controller for causing an ejection and curing operation to be performed for ejecting the photo-curing ink and subsequently radiating the light to cure the photo-curing ink, the controller being configured so that when an image having a first degree of gloss is formed, the image is formed by a first number of ejection and curing operations, and when an image having a second degree of gloss lower than the first degree of gloss is formed, the image is formed by a second number of ejection and curing operations greater than the first number.

In the case that an image is formed by a plurality of ejection and curing operations, the photo-curing ink ejected to the medium is cured each time the photo-curing ink is deposited. Curing thereby takes place before the photo-curing ink integrates with adjacent ink. Consequently, the probability of integration with adjacent ink decreases the greater the number of ejection and curing operations is performed, and diffused reflection of light by the ink fixed in a hemispherical shape is more likely to occur. Specifically, printed matter having a different degree of gloss can easily be provided by varying the number of ejection and curing operations.

Preferably, in this printing device, the head includes at least a first head and a second head;

the photo-irradiation device includes at least a first partial curing photo-irradiation device and a second partial curing photo-irradiation device; and during the second number of ejection and curing operations, after the photo-curing ink is ejected from the first head, the photo-curing ink is cured by the first partial curing photo-irradiation device, and after the photo-curing ink is ejected from the second head, the photo-curing ink is cured by the second partial curing photo-irradiation device.

Through this configuration, when the second number of ejection and curing operations is performed, the ejection and curing operation can be performed a plurality of times.

Preferably, the photo-irradiation device further includes a main curing photo-irradiation device; and during the first number of ejection and curing operations, after the photo-curing ink is ejected from the first head and the photo-curing ink is ejected from the second head, the photo-curing ink is cured by the main curing photo-irradiation device.

Through this configuration, when the first number of ejection and curing operations is performed, the ejection and curing operation can be performed one time.

The first head and the second head preferably each eject the same single color of ink. Through this configuration, a plurality of heads for ejecting a single color of ink can be provided to perform the ejection and curing operation.

The first head and the second head can each eject the same combination of a plurality of colors of ink. Through this configuration, heads are provided for ejecting a plurality of colors of ink, and the number of corresponding partial curing photo-irradiation devices can therefore be reduced. Preferably, the photo-curing ink is an ultraviolet-curing ink, and the photo-irradiation device radiates ultraviolet rays. Through this configuration, the ink can be cured through use of ultraviolet rays.

The first number is preferably one. Through this configuration, an image having the highest degree of gloss can be formed in image formation at the first degree of gloss.

At least the aspect described below will become apparent from the description of the present specification and accompanying drawings. Specifically, an aspect of the invention resides in a printing method including:

determining whether to form an image having a first degree of gloss or an image having a second degree of gloss lower than the first degree of gloss; and forming an image by performing the ejection and curing operation for ejecting the photo-curing ink and subsequently radiating light to cure the photo-curing ink the first number of times when an image having the first degree of gloss is to be formed, and forming an image by performing the ejection and curing operation a second number of times greater than the first number when an image having the second degree of gloss is to be formed.

In the case that an image is formed by a plurality of ejection and curing operations, the photo-curing ink ejected to the medium is cured each time the photo-curing ink is deposited. Curing thereby takes place before the photo-curing ink integrates with adjacent ink. Consequently, the probability of integration with adjacent ink decreases the greater the number of ejection and curing operations is performed, and diffused reflection of light by the ink fixed in a hemispherical shape is more likely to occur. Specifically, printed matter having a different degree of gloss can easily be provided by varying the number of ejection and curing operations.

First Embodiment

A printer 1 in a first embodiment is capable of ejecting four color inks and a transparent clear ink. The inks used in the first embodiment are UV inks (ultraviolet-curing inks).

Figure 2:
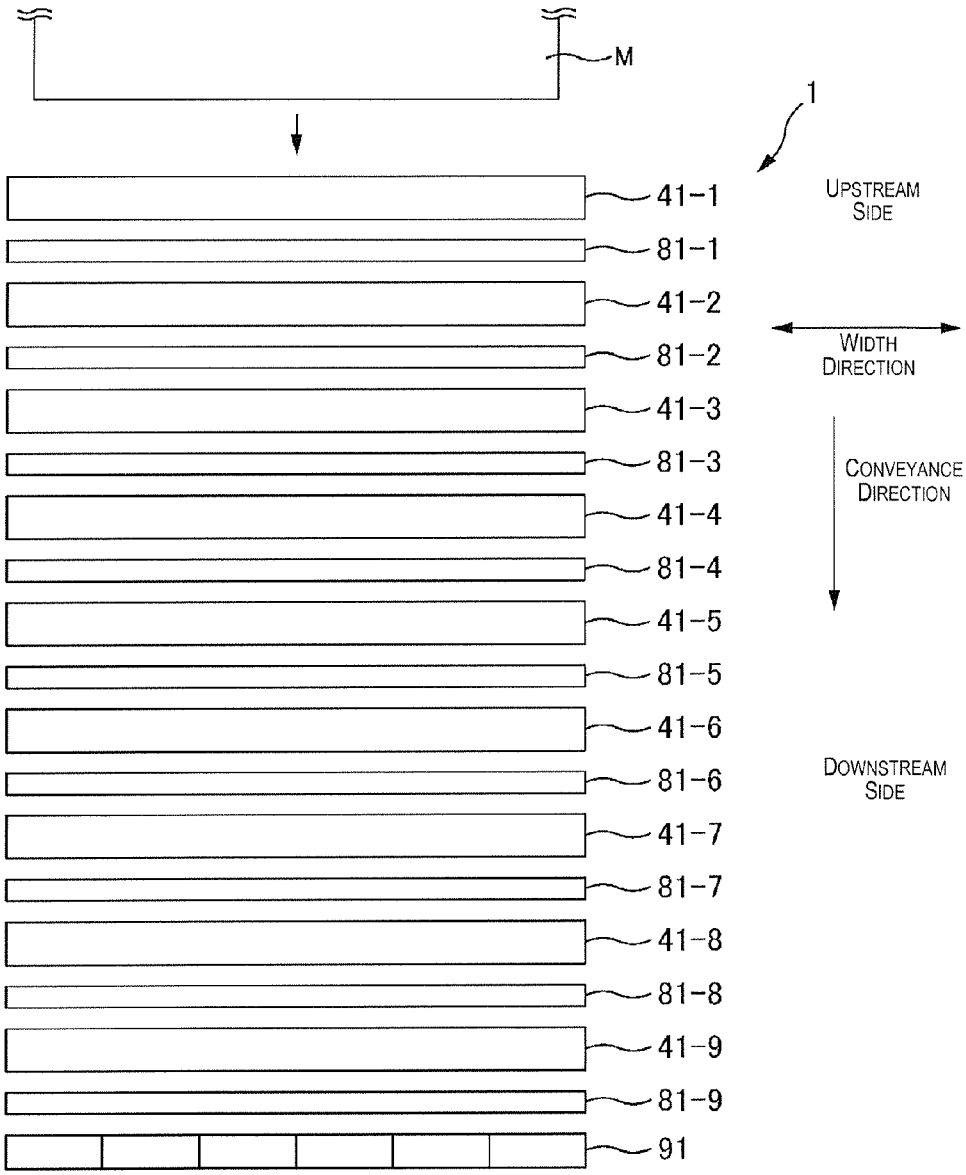
FIG. 2 is a rough top view showing the printer 1 according to the first embodiment.
Figure 3:
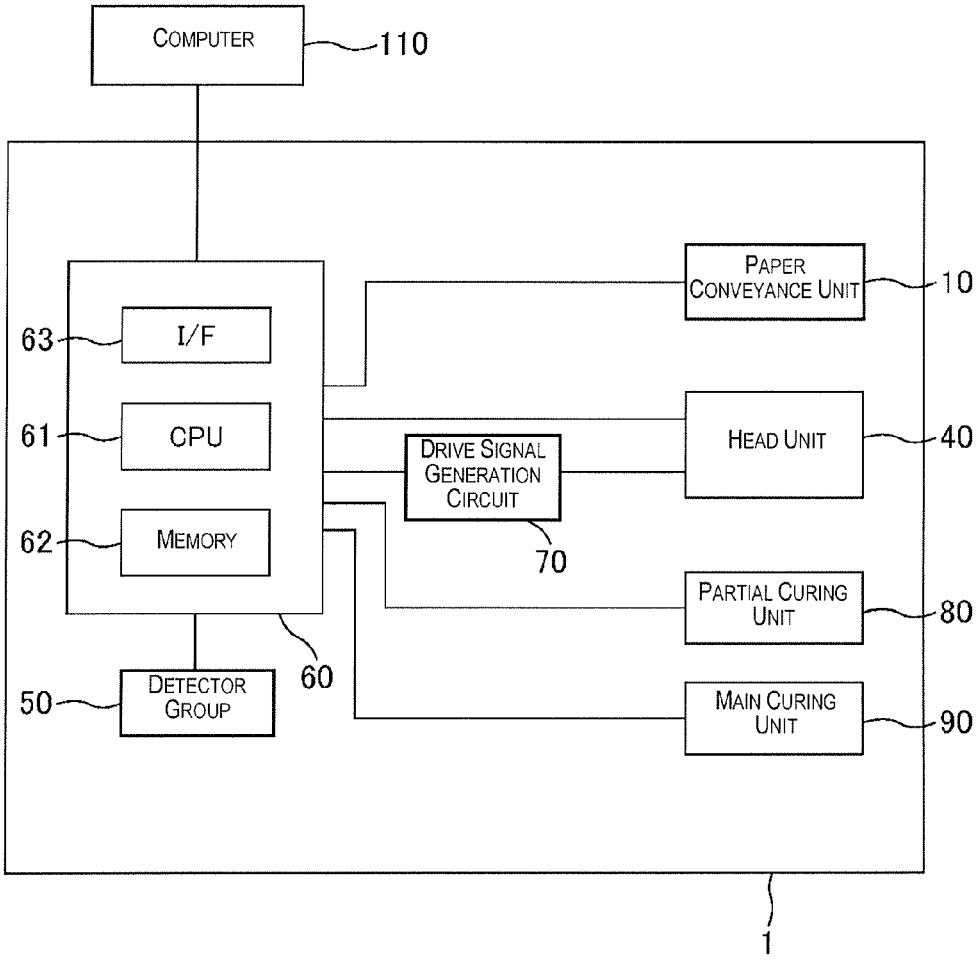
FIG. 3 is a block diagram showing the printer 1 according to the first embodiment.

FIG. 1 is a rough side view showing the printer 1 in the first embodiment. FIG. 2 is a rough top view showing the printer 1 in the first embodiment. FIG. 3 is a block diagram showing the printer 1 in the first embodiment. The configuration of the printer 1 will be described with reference to these drawings.

FIG. 3 shows the printer 1 and a computer 110. The printer 1 is provided with a paper conveyance unit 10, a head unit 40, a detector group 50, a controller 60, a drive signal generation circuit 70, a partial-curing unit 80, and a full-curing unit 90.

The paper conveyance unit 10 includes a conveyance roller 11A, a first presser roller 11B, a paper exit roller 12A, and a second presser roller 12B. The conveyance roller 11A and the paper exit roller 12A are connected to a motor not shown in the drawing, and the rotation of the motor is controlled by the controller 60. A medium is held between the conveyance roller 11A and the first presser roller 11B and thereby conveyed in the conveyance direction. The medium is also held between the conveyance roller 12A and the first presser roller 12B and thereby conveyed in the conveyance direction and discharged.

The head unit 40 includes a first yellow head unit 41-1 (corresponding to a first head), a second yellow head unit 41-2 (corresponding to a second head), a first magenta head unit 41-3, a second magenta head unit 41-4, a first cyan head unit 41-5, a second cyan head unit 41-6, a first black head unit 41-7, and a second black head unit 41-8. The head unit 40 also includes a clear ink head unit 41-9. The configuration of these head units is described hereinafter.

The detector group 50 includes various detectors for detecting information of each component of the printer 1 and sending the information to the controller 60.

The controller 60 is a control unit for controlling the printer 1. The controller 60 has a CPU 61, a memory 62, and an interface section 63. The CPU 61 is a computational processing device for controlling the printer as a whole. The memory 62 maintains a working area, an area for storing a program of the CPU 61, and other areas, and has a RAM, EEPROM, or other storage element. The CPU 61 controls each unit in accordance with a program stored in the memory 62. The interface section 63 transmits and receives data between the printer 1 and the computer 110, which is an external device.

The drive signal generation circuit 70 generates drive signals which are applied to piezo elements or other drive elements included in the head described hereinafter to cause ink droplets to be discharged. The drive signal generation circuit 70 includes a DAC not shown in the drawing. Analog voltage signals are generated on the basis of digital data that relate to the waveform of a drive signal sent from the controller 60. The drive signal generation circuit 70 also includes an amplifier circuit not shown in the drawing, and amplifies the power of the generated voltage signal to generate a drive signal.

The partial-curing unit 80 radiates ultraviolet rays to ultraviolet-curing ink deposited on the medium and semi-cures ("partial curing" is referred to hereinafter as "pinning") the deposited ink. Specifically, the viscosity at the surface of the ink deposited on the medium is increased to suppress movement of the ink. By thus increasing the viscosity at the surface of the deposited ink, ink deposits can be made less prone to move together when other ink is deposited in the vicinity of the deposited ink. Specifically, integration of ink deposits can be suppressed.

The partial-curing unit 80 includes nine sets of LED assembly units 81-1 through 81-9. These LED assembly units 81-1 through 81-9 partially cure the ink ejected on the upstream sides thereof in the conveyance direction of the medium M. The configuration of the LED assembly units 81 is described hereinafter.

The full-curing unit 90 includes a full-curing light source unit 91 (corresponding to the full-curing photo-irradiation device). The full-curing light source unit 91 is disposed at the downstream end in the conveyance direction, as shown in FIG. 2. Light including ultraviolet rays is radiated to the medium M, and the each ink deposited on the medium M is fully cured. For full curing, a metal halide lamp is used as the light source of the full-curing light source unit 91 in the present embodiment.

Figure 4A:
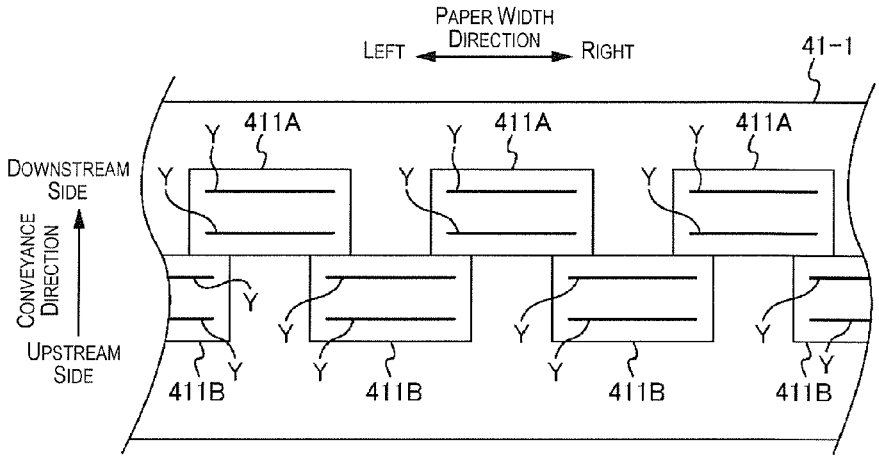
FIG. 4A is a view showing the head arrangement in the first yellow head unit 41-1.
Figure 4B:
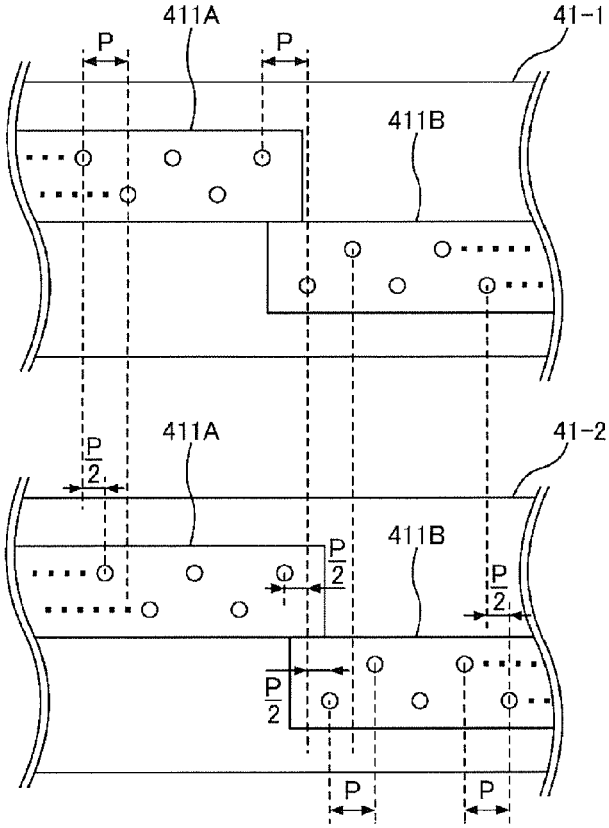
FIG. 4B is a view showing the nozzle arrangement in the first yellow head unit 41-1 and the second yellow head unit 41-2.

FIG. 4A is a view showing the head arrangement in the first yellow head unit 41-1. FIG. 4B is a view showing the nozzle arrangement in the first yellow head unit 41-1 and the second yellow head unit 41-2. FIG. 4A shows a downstream head 411A and upstream head 411B included in the first yellow head unit 41-1. The downstream head 411A and the upstream head 411B each have substantially the same configuration. These heads each have two nozzle rows.

FIG. 4B shows the nozzle pitch P of the downstream head 411A and the nozzle pitch P of the upstream head 411B. The nozzle pitch P formed by each of the two nozzle rows is 300 dpi in the present embodiment. The nozzle pitch formed by the nozzles of the first yellow head unit 41-1 and the nozzles of the second yellow head unit 41-2 is P/2, which is 600 dpi. Specifically, the printer 1 of the present embodiment is capable of printing at a maximum resolution of 600 dpi in the paper width direction.

The nozzle pitch is described above using the first yellow head unit 41-1 and the second yellow head unit 41-2 as examples, but same nozzle pitch is used in the first magenta head unit 41-3 and the second magenta head unit 41-4 as well. The same nozzle pitch is also used in the first cyan head unit 41-5 and the second cyan head unit 41-6. The same nozzle pitch is also used in the first black head unit 41-7 and the second black head unit 41-8.

Figure 5A:
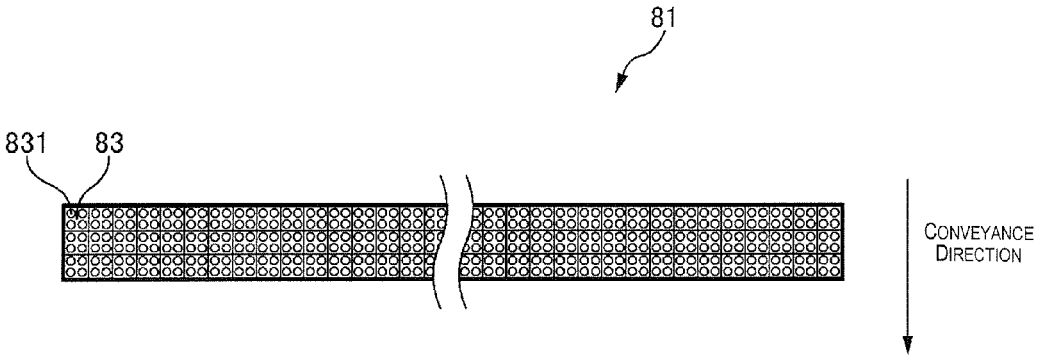
FIG. 5A is a view showing the LED assembly unit 81 in the partial-curing unit 80.

FIG. 5A is a view showing the LED assembly units 81 in the partial-curing unit 80. The partial-curing unit 80 includes 9 sets of LED assembly units 81-1 through 81-9. Nine of the LED assembly units 81 have the same configuration to reduce manufacturing cost.

The LED assembly units 81 are composed of a plurality of LEDs 831. An illumination area wider than the width of the printed medium is thereby provided. The LEDs 831 used in the present embodiment have a peak wavelength of 385 to 405 nm. The supplied current is adjusted to give a pinning energy (partial curing energy) of 2 to 20 $mJ/cm^2$ in the present embodiment.

Figure 5B:
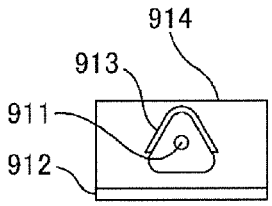
FIG. 5B is a side view showing the main curing light source unit 91.

FIG. 5B is a side view showing the full-curing light source unit 91. The full-curing light source unit 91 is provided with a metal halide lamp 911 which forms the light source part, and a protective glass 912, a reflecting mirror 913, and a light-source-side case 914.

The metal halide lamp 911 radiates light for fully curing the ink deposited on the medium. The light radiated by the metal halide lamp 911 used in the present embodiment includes a large ultraviolet component, and cures ultraviolet-curing ink. The reflecting mirror 913 reflects the light radiated from the metal halide lamp 911 toward the medium, and the light from the metal halide lamp 911 is thereby efficiently radiated to the medium. The protective glass 912 prevents entry of debris from the passage of the medium while passing the light from the metal halide lamp 911 to the medium. The light-source-side case 914 is a case for attaching the metal halide lamp 911, the protective glass, and the reflecting mirror 913. Through use of such a full-curing light source unit 91, ink that is partially cured or not partially cured can be fully cured on the medium.

In the present embodiment, a plurality of such metal halide lamps 911 is provided in the width direction of the medium, and ultraviolet rays can be radiated to the entire surface of the conveyed medium.

Figure 6:
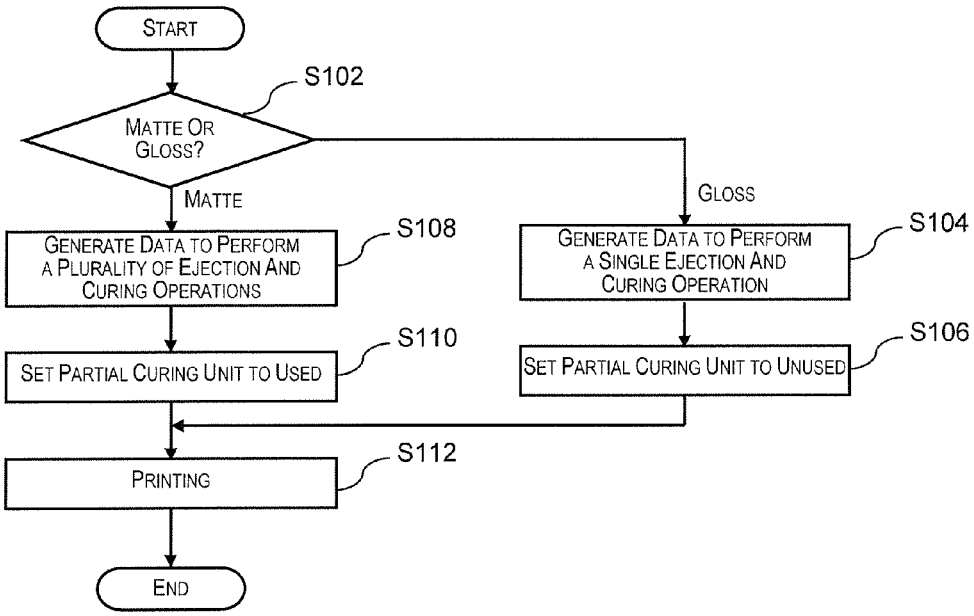
FIG. 6 is a flowchart showing the process of the printing method in the first embodiment.

FIG. 6 is a flowchart showing the process of the printing method in a first embodiment. The printing method according the first embodiment will first be described with reference to the flowchart of FIG. 6.

First, a determination is made as to whether to print an image as a matte image or a glossy image (S102). Here, whether to print an image as matte or glossy is set in advance by a user via a printer driver.

Here, in the case that glossy printing is selected, the printer driver generates printing data for transmission to the printer 1 so that an image is formed by a single (one) ejection and curing operation. The ejection and curing operation is an operation whereby ink is ejected, and ultraviolet rays are subsequently radiated to cure the ink on the medium. In other words, one ejection and curing operation is completed at the stage at which at least one (or more than one) ink ejection is performed and ultraviolet rays are subsequently radiated. In the case that glossy printing is selected, the partial-curing device is not used, and the ink on the medium is cured solely by the full-curing device, as described hereinafter. Consequently, printing data are generated whereby an image is formed by appropriate use of the heads of the printer 1.

The partial-curing unit is then set to "unused" (S108). Printing is then performed (S112). By thus printing without using the partial-curing unit, after the color ink and the clear ink have been ejected, all the ink is cured at once by the full-curing unit. The plurality of colors of color ink and the clear ink adjacent to each other on the medium thus integrate by surface tension, and are then cured. It is therefore possible to provide a glossy printed matter having a high degree of gloss such as described hereinafter.

In the case that matte printing is selected, the printer driver generates printing data for transmission to the printer 1 so that an image is formed by a plurality of ejection and curing operations. In the printing data for forming an image by a plurality of ejection and curing operations, a plurality of heads including an upstream head and a downstream head for at least one color of ink are tasked with ejection ink, for example. In ejection of yellow ink, for example, the printing data are configured so that the first yellow head unit 41-1 and the second yellow head unit 41-2 contribute to ejecting yellow ink.

The partial-curing unit is then set to "used" (S110). Printing is then performed (S112). Through this configuration, after the ink ejected by the upstream head is partially cured, the downstream ink is ejected and partially cured. For example, the yellow ink ejected from the first yellow head unit 41-1 is partially cured by the LED assembly unit 81-1 (which corresponds to the first partial-curing photo-irradiation device), after which the yellow ink ejected from the second yellow head unit 41-2 is partially cured by the LED assembly unit 81-2 (which corresponds to the second partial-curing photo-irradiation device).

Through this configuration, unlike the glossy printing described above, ink deposits are partially cured before integrating due to surface tension, and it is possible to provide a matte printed matter having a low degree of gloss such as described hereinafter.

Figure 7:
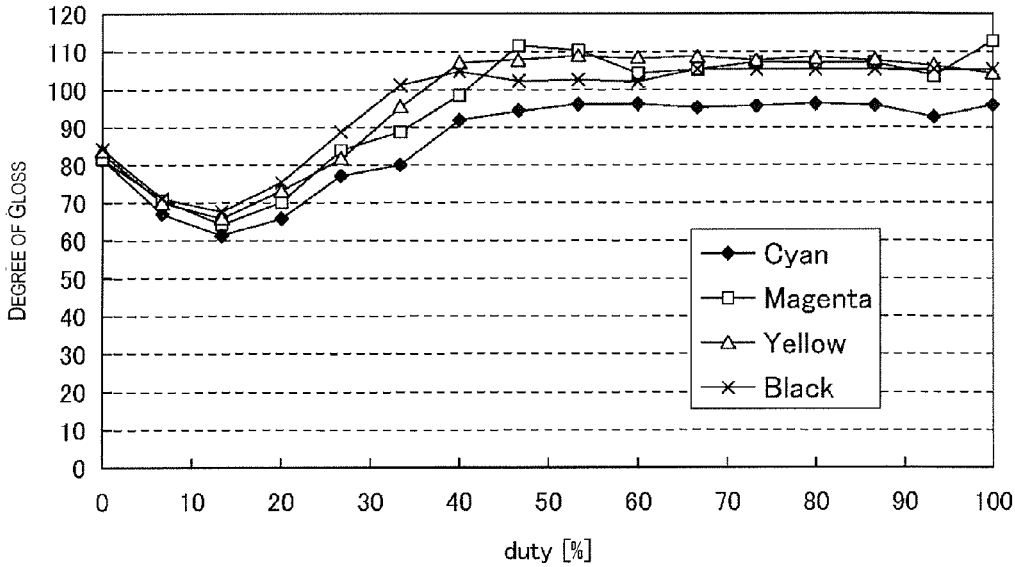
FIG. 7 is a first view showing the relationship between the pass count and the degree of gloss.

FIG. 7 is a first view showing the relationship between the pass count and the degree of gloss in a comparative example. FIG. 7 shows the degree of gloss in a case in which glossy printing is performed by the printing procedure described above. In FIG. 7, the horizontal axis shows the duty (print duty), and the vertical axis shows the degree of gloss. The term "duty" here refers to the amount of ink applied for a pixel. Here, a duty of 100% indicates that all pixels are filled with a single color of ink. The degree of gloss is obtained using a Handy Gloss Meter PG-1M manufactured by Nippon Denshoku Industries Co., Ltd. In the present embodiment, degree of gloss was measured at a single angle of 60°.

As a result, although the degree of gloss is somewhat decreased when the duty is 0% to 30% (low-duty side), the overall degree of gloss is high.

Figure 8:
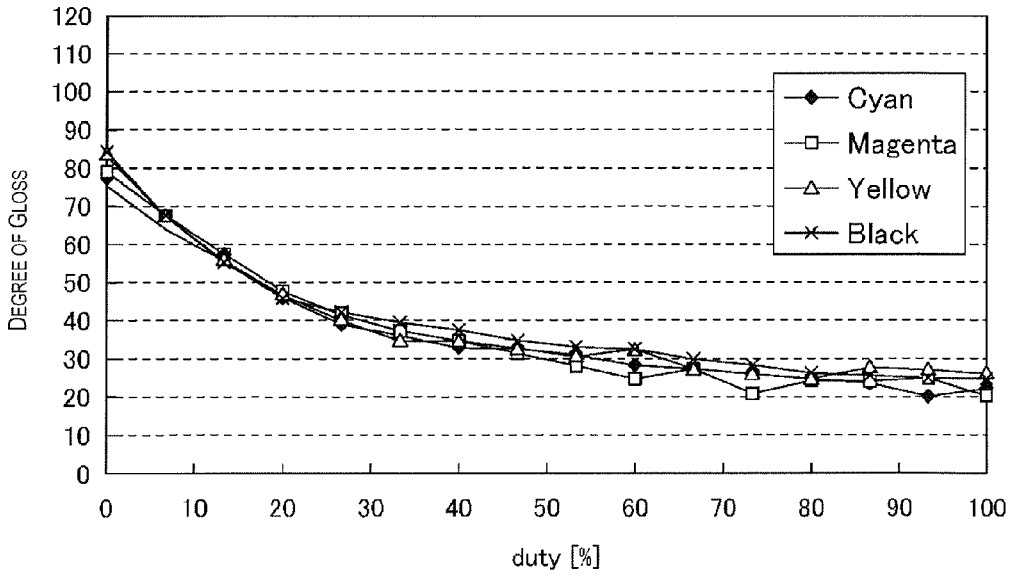
FIG. 8 is a second view showing the relationship between the pass count and the degree of gloss.

FIG. 8 is a second view showing the relationship between the pass count and the degree of gloss. FIG. 8 shows the degree of gloss in a case in which matte printing is performed by the printing procedure described above. As a result, although the degree of gloss is somewhat high on the low-duty side, it is apparent that matte printing is achieved in which the overall degree of gloss is low.

Figure 9:
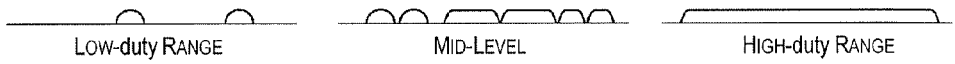
FIG. 9 is a view showing the ink shape of glossy printing in the first embodiment.
Figure 10:
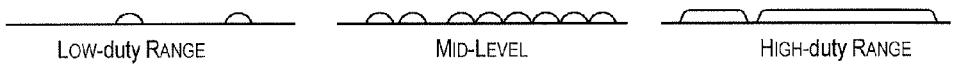
FIG. 10 is a view showing the ink shape of matte printing in the first embodiment.

FIG. 9 is a view showing the ink shape of glossy printing in the first embodiment. FIG. 10 is a view showing the ink shape of matte printing in the first embodiment. FIGS. 9 and 10 will be compared. In the low-duty range, since the ejected quantity of ink droplets is small, ink on the medium does not come in contact with adjacent ink, and the ink is cured by ultraviolet rays while maintaining a hemispherical shape.

In the mid-level region of FIG. 9 (showing the results of glossy printing), a case is added in which the ink ejected by the upstream head (head unit) and the ink ejected by the downstream head (head unit) are adjacent to each other on the medium. When adjacent ink deposits touch each other, surface tension causes the ink deposits to integrate on the medium. Since the ink deposits are cured by the full-curing unit 90 after integrating in this manner, the ratio of ink having a flattened surface increases, and as a result, the ratio of diffusely reflected light decreases, and the printed matter then appears to have a high degree of gloss.

FIG. 10 (showing the results of matte printing) adds a case in which the ink ejected by the upstream head (head unit) and the ink ejected by the downstream head (head unit) are adjacent to each other on the medium in the mid-level region as well. However, in matte printing in the first embodiment, each time that ink ejected by the upstream head (head unit) is deposited on the medium, the ink is partially cured by the partial-curing unit. Each time that ink ejected by the downstream head (head unit) is deposited on the medium, the ink is also partially cured by the partial-curing unit. Both of these inks thus maintain a hemispherical shape without integrating on the medium. When ink deposits cured in this manner are arranged on the medium, light is diffusely reflected by the hemispherical ink deposits, and as a result, the printed matter appears to have a low degree of gloss.

The difference between FIGS. 9 and 10 is more apparent in the high-duty ranges thereof. Specifically, since the quantity of ejected ink increases, adjacent ink deposits integrate more readily when partial curing is not performed. When partial curing is performed, the ratio of ink that diffusely reflects light increases. Consequently, there is more of a decrease in the degree of gloss in the high-duty range when matte printing is performed.

The degree of gloss of an image can also be adjusted by dividing printing into cases in which an image is formed by only a single ejection and curing operation for ejecting ink and subsequently radiating ultraviolet rays to cure the ink, and cases in which an image is formed by performing multiple ejection and curing operations. Here, glossy printing is described as being performed by a single ejection and curing operation, but this number of ejection and curing operations is not limited to one insofar as the number is less than the number of ejection and curing operations that is performed during matte printing.

Second Embodiment

Figure 11:
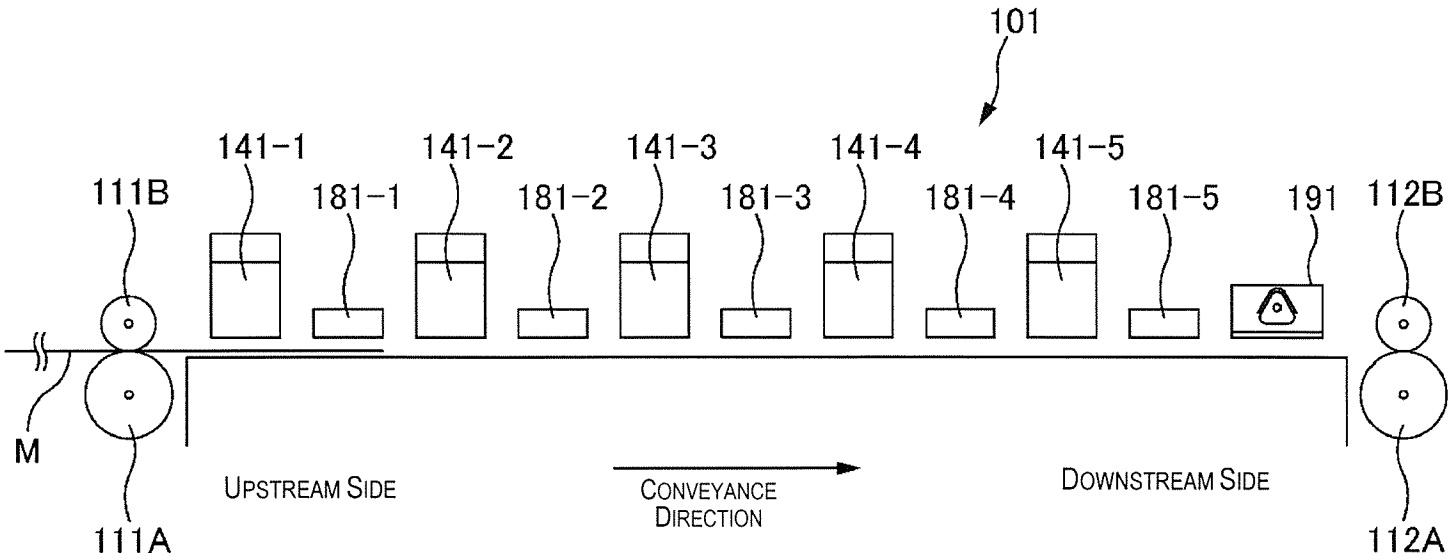
FIG. 11 is a rough side view showing the printer 1 in a second embodiment.
Figure 12:
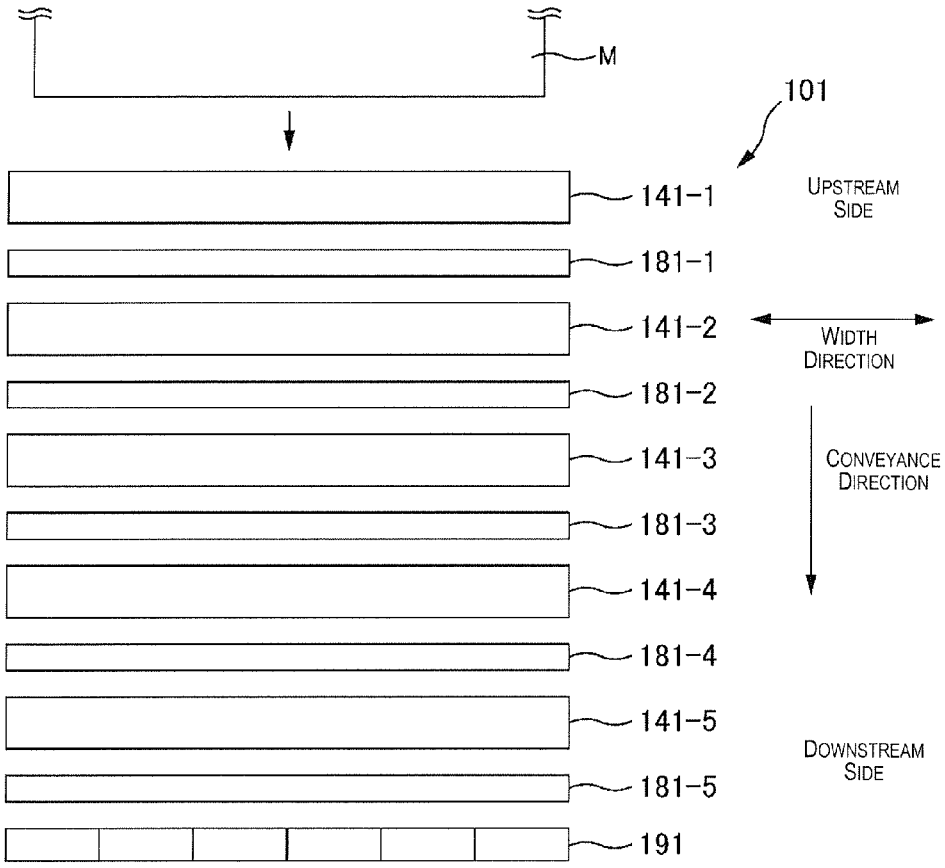
FIG. 12 is a rough side view showing the printer 1 in the second embodiment.

FIG. 11 is a rough side view showing the printer 1 in a second embodiment. FIG. 12 is a rough side view showing the printer 1 in the second embodiment. The configuration of components of the second embodiment other than the head unit 40 in the first embodiment is substantially the same as in the first embodiment. Reference numerals for the second embodiment are obtained by adding 100 to the reference numerals for the first embodiment, and components that are the same as in the first embodiment will not be described. The configuration of the head unit that differs from the first embodiment will be described.

The second embodiment differs from the first embodiment with respect to the order of inks ejected by the heads of the head units. In the second embodiment, a head unit 141-1 ejects yellow ink and magenta ink. A head unit 141-3 also ejects yellow ink and magenta ink. A head unit 141-2 ejects cyan ink and black ink. A head unit 141-4 also ejects cyan ink and black ink. A head unit 141-5 ejects clear ink only.

Figure 13A:
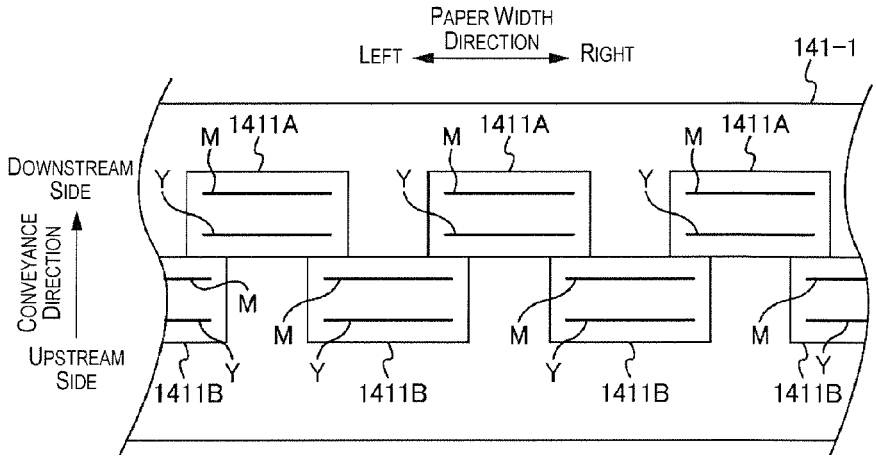
FIG. 13 is a view showing the head arrangement in the head units of the second embodiment.
Figure 13B:
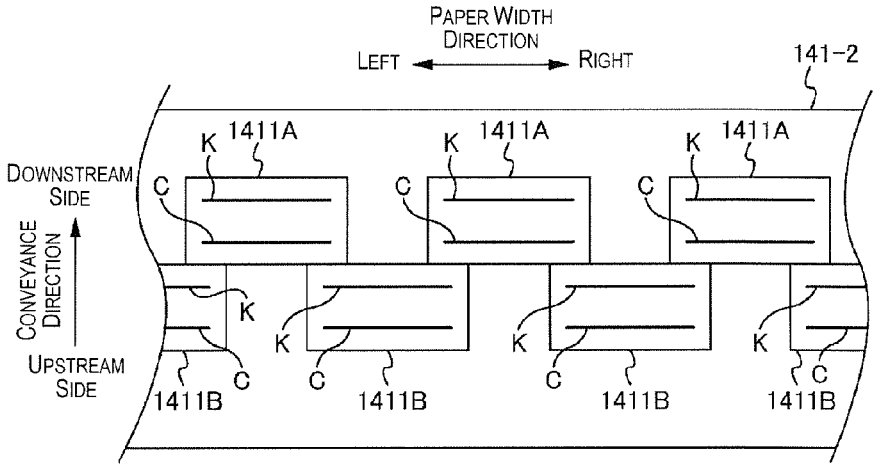
Figure 13C:
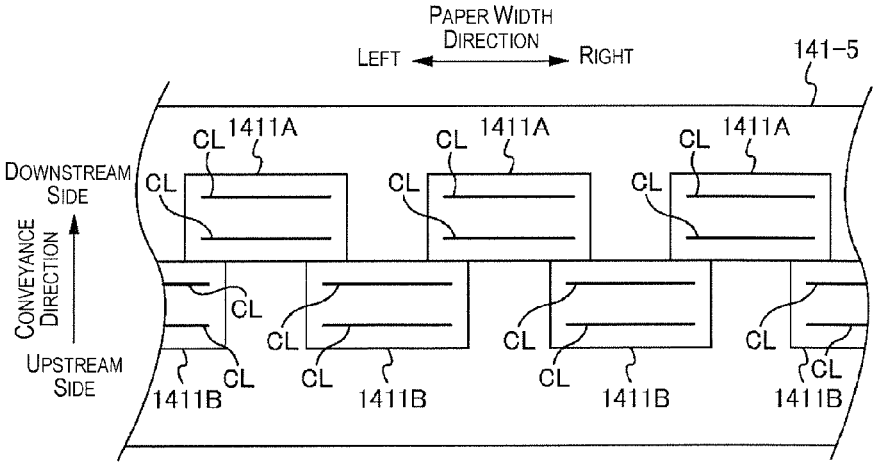

FIG. 13 is a view showing the head arrangement in the head units of the second embodiment. In FIG. 13, the nozzle rows on the upstream side in upstream heads 1411B of the head unit 141-1 eject yellow ink, and the nozzle rows on the downstream side thereof eject magenta ink. The nozzle configuration of downstream heads 1411A is the same as in the upstream heads 1411B in this case as well. The head unit 141-3 as a head unit downstream from the head unit 141-1 has substantially the same configuration as the head unit 141-1, but the positions of the nozzles are offset the distance P/2 in the paper width direction with respect to the nozzles of the head unit 141-1. Printing by the nozzles of the head unit 141-1 and the nozzles of the head unit 141-3 can thereby be performed at a resolution of 600 dpi in the paper width direction.

In the heads of the head unit 141-2, the nozzle rows on the upstream side eject cyan ink and the nozzle rows on the downstream side eject black ink. The heads of the head unit 141-4 also have substantially the same configuration, but in this case as well, the positions of the nozzles are offset the distance P/2 in the paper width direction with respect to the nozzles of the head unit 141-2, and printing can thereby be performed at a resolution of 600 dpi in the paper width direction.

All of the nozzle rows of the head unit 141-5 eject clear ink.

In this configuration as well, in the case of matte printing, through use of the LED assembly units, the first yellow ink ejection is performed by the head unit 141-1 and subsequently partially cured by an LED assembly unit 181-1, and the second yellow ink is performed by the head unit 141-3 and subsequently partially cured by an LED assembly unit 181-3, for example. Through this configuration, adjacent yellow ink deposits are partially cured before integrating due to surface tension, and it is possible to provide a matte printed matter having a low degree of gloss.

On the other hand, in a configuration in which the LED assembly units are not used in the case of glossy printing, yellow ink is ejected by the head unit 141-1, and yellow ink is ejected by the head unit 141-3. Adjacent yellow ink deposits then integrate due to surface tension. These ink deposits are then cured by the main curing unit 90 (main curing light source unit 91), and a printed matter having a high degree of gloss can therefore be provided.

Adopting a head configuration such as that of the second embodiment makes it possible to have a smaller number of head units and LED assembly units than by the first embodiment.

Other Embodiments

The printer 1 is described as a liquid ejection device in the above embodiments. However, the liquid ejection device is not limited to a printer, and the liquid ejection device can also eject or discharge a fluid (liquid, liquid body in which particles of a functional material are dispersed, or a fluid such as a gel) other than ink. For example, the same techniques as those of the embodiments described above can be applied to various types of devices which utilize an inkjet technique, such as color filter manufacturing devices, dyeing devices, micro-fabrication devices, semiconductor manufacturing devices, surface processing devices, three-dimensional modeling devices, vaporization devices, organic EL manufacturing devices (particularly polymer EL manufacturing devices), display manufacturing devices, film formation devices, and DNA chip manufacturing devices. These methods and manufacturing methods are also within the range of application of the invention.

The embodiments described above are intended to facilitate understanding of the invention and shall not be construed as limiting the invention. The invention can be modified or improved within the intended scope thereof, and it shall be apparent that the invention encompasses equivalents thereto.

<Heads>

In the embodiments described above, piezoelectric elements are used to discharge ink. However, the scheme whereby liquid is discharged is not thus limited. For example, a scheme whereby bubbles are generated in the nozzles by heat, or another scheme can also be used.

What is claimed is:

1. A printing device comprising:

a first head configured to eject a photo-curing ink from a nozzle array to a medium;

a conveyance unit configured to convey the medium in a conveyance direction intersecting the nozzle array;

a partial photo-irradiation device configured to radiate light to the photo-curing ink ejected on the medium and partially cure the photo-curing ink, the partial photo-irradiation device being disposed downstream relative to the first head in the conveyance direction;

a main photo-irradiation device configured to radiate light to the photo-curing ink ejected on the medium and fully cure the photo-curing ink, the main photo-irradiation device being disposed downstream relative to the partial photo-irradiation device in the conveyance direction; and a controller configured to control the partial photo-irradiation device and the main photo-irradiation device, the controller being configured to, while a first printing mode is selected, control the partial photo-irradiation device and the main photo-irradiation device such that the main photo-irradiation device radiates light to the photo-curing ink ejected to the medium while the partial photo-irradiation device stops radiating light, and the controller being configured to control the partial photo-irradiation device and the main photo-irradiation device such that the partial photo-irradiation device and the main photo-irradiation device radiate light to the photo-curing ink ejected to the medium while a second printing mode is selected, the second printing mode being a mode in which an image having a degree of gloss lower than a degree of gloss in the first printing mode is formed.

2. The printing device according to claim 1, further comprising a second head, wherein the partial photo-irradiation device includes at least a first partial curing photo-irradiation device and a second partial curing photo-irradiation device, the first partial curing photo-irradiation device is disposed downstream relative to the first head in the conveyance direction, the second head is disposed downstream relative to the first partial curing photo-irradiation device in the conveyance direction, the second partial curing photo-irradiation device is disposed downstream relative to the second head in the conveyance direction, and after the photo-curing ink is ejected from the first head, the photo-curing ink is cured by the first partial curing photo-irradiation device, and after the photo-curing ink is ejected from the second head, the photo-curing ink is cured by the second partial curing photo-irradiation device.

3. The printing device according to claim 2, wherein the first head and the second head each eject the same single color of ink.

4. The printing device according to claim 2, wherein the first head and the second head each eject the same combination of a plurality of colors of ink.

5. The printing device according to claim 1, wherein the photo-curing ink is an ultraviolet-curing ink, and the partial photo-irradiation device and the main photo-irradiation device radiate ultraviolet rays.

6. A printing method comprising:

determining whether to form an image having a first degree of gloss or an image having a second degree of gloss lower than the first degree of gloss; and fully curing a photo-curing ink without partially curing the photo-curing ink after ejecting the photo-curing ink when determining the image having the first degree of gloss is formed, or fully curing the photo-curing ink after partially curing the photo-curing ink when determining the image having the second degree of gloss is formed.

* * * * *